United States Patent [19]

MacDonald

[11] 4,103,392

[45] Aug. 1, 1978

[54] DOOR CLOSING APPARATUS

[75] Inventor: Robert D. MacDonald, Phoenix, Ariz.

[73] Assignee: Masco Corporation, Taylor, Mich.

[21] Appl. No.: 735,305

[22] Filed: Oct. 26, 1976

[51] Int. Cl.[2] ..... E05F 3/20

[52] U.S. Cl. ..... 16/54

[58] Field of Search ..... 16/54, 51, 56, 52, 49, 16/50, 74, 68, 128 R; 49/137

[56] References Cited

U.S. PATENT DOCUMENTS

| | | | |
|---|---|---|---|
| 1,824,217 | 9/1931 | Kreiner | 16/54 |
| 2,200,865 | 5/1940 | Stannard | 16/54 |
| 2,591,476 | 4/1952 | Swanson | 16/54 |
| 3,117,340 | 1/1964 | Arboll | 16/54 |
| 3,118,167 | 1/1964 | Morr et al. | 16/54 |
| 3,778,866 | 12/1973 | Nakanishi | 16/49 |

*Primary Examiner*—Ronald Feldbaum

[57] ABSTRACT

An apparatus for automatically closing a door with respect to a fixed support adjacent thereto which includes a torsional spring, a one-way clutch mechanism and a swash plate hydraulic damper concealably retained within a compact housing. The housing is secured to either the door or the fixed support and a first rotatable portion of the one-way clutch is coupled to the other of either of the door or fixed support so that the first rotatable portion rotates in a first direction when the door is opened in the opposite direction when the door is closed. The torsional spring is at least partially disposed about the one-way clutch mechanism and has one end anchored to the housing and the other end secured for movement with the first rotatable portion. As the door is opened, the first rotatable portion is rotated in the first direction to wind up the torsional spring. When the door is released, the torsional spring unwinds to reverse the process and close the door. As the torsional spring unwinds, the first rotatable portion is driven in the opposite direction causing the one-way clutch mechanism to drive a second rotatable portion in the opposite direction as well. The swash plate hydraulic damper includes a plurality of piston chambers formed in the second rotatable portion, a closed hydraulic circuit interconnecting the piston chambers, and a piston element slidably disposed in each of the chambers for sealing the same and having an end portion extending therefrom. The hydraulic damper includes a wedge-shaped swash plate whose upper surface operatively engages the exposed end portions of the piston elements to restrict the rotation of the second rotatable portion so as to control the rate at which the spring unwinds to close the door. The resistance encountered by the pistons can be selectively varied by adjusting the rotational position of the swash plate with respect to the bottom of the housing. In the preferred embodiment disclosed herein, the compact housing forms the central portion of an ordinary hinge having one plate secured to the door and the other plate secured to the door casing although the housing could be mounted on or within the door itself. The compact assembly of the present invention enables a door to be automatically closed with a relatively constant closing force and provides a means whereby the force may be selectively adjusted.

23 Claims, 10 Drawing Figures

FIG. 3
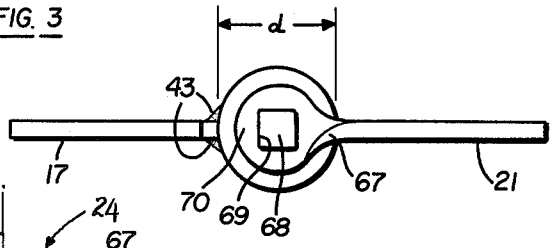
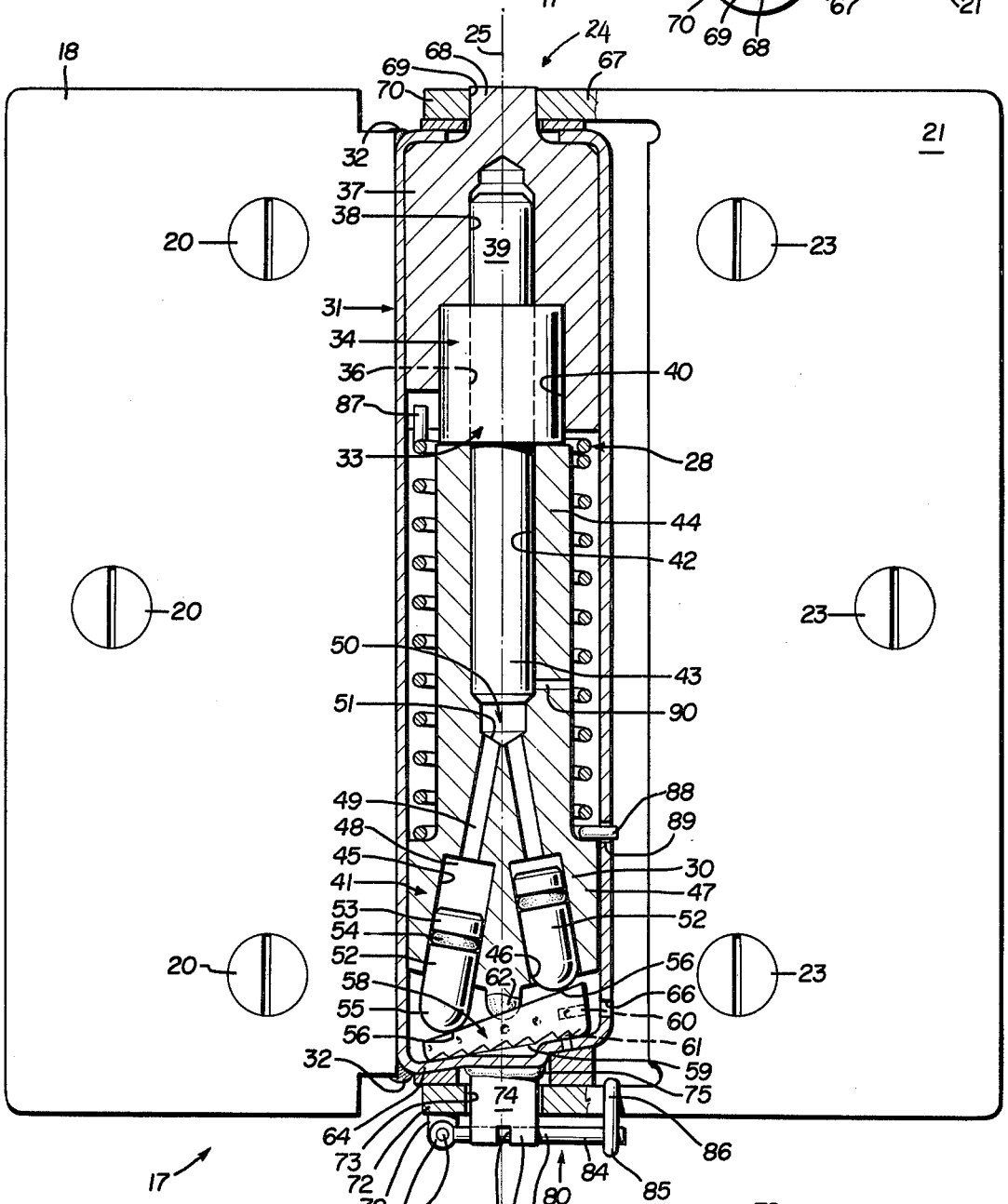
FIG. 2
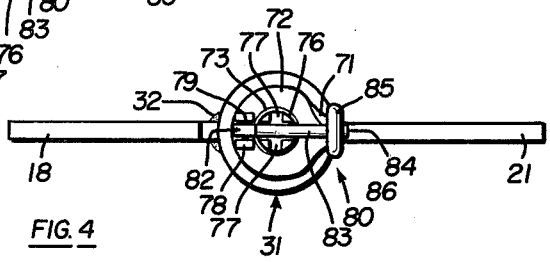
FIG. 4

DOOR CLOSING APPARATUS

RELATED CASES

This application is an improvement over my earlier filed application, Ser. No. 735,305, filed on July 16, 1976, now abandoned, for a Spring-Operated Door Closer.

BACKGROUND OF THE INVENTION

This invention relates to door closers and more particularly to a spring-operated door closing apparatus having a hydraulic damper for controlling the rate at which a door is closed.

The prior art teaches many types of door closing apparatus most of which are relatively large, bulky and aesthetically unsightly. Most of these door closers involve cumbersome lever arm arrangements which do not result in a constant closing force and the lever arms often interfere with passage through the doorway. Additionally, most of the dampers employed in the prior art for controlling the rate at which a door is automatically closed are also large and unsightly.

Typical of the spring-operated door closers of the prior art are U.S. Pat. No. 171,171 which issued to J. A. Robbins on Dec. 14, 1875 and U.S. Pat. No. 403,922 which issued to J. W. Davis on May 28, 1889. Typical of the more modern dampers for controlling the rate at which a door closes in U.S. Pat. No. 3,680,181 which issued to R. D. MacDonald on Aug. 1, 1972 but even these more modern dampers are relatively bulky and unsightly.

The automatic door closers of the prior art are unable to achive an essentially constant force for closing the door as its position changes. Many of these door closers are more difficult to open, often do not have sufficient force to insure latching as the door approaches its closed position and often produce excess force when the door is initially released which could cause physical injury or property damage. While a few of the dampers of the prior art are adjustable, the adjustments are very coarse, are often unreliable and require frequent adjustments depending upon door usage.

The present invention avoids all of the problems and disadvantages of the prior art by providing an automatic door closing apparatus which is extremely compact and efficient. The door closer of the present invention may be concealed within the door itself or mounted thereto. Additionally, it may form a portion of a door hinge so as to be concealed within the central portion of the hinge itself. The door closer of the present invention yields a relatively constant closing force and the swash plate hydraulic damper is a highly compact, relatively efficient means for selectively controlling the rate at which the door closes.

BRIEF SUMMARY OF THE INVENTION

This invention provides a compact apparatus for automatically closing doors. The door closer includes a torsional spring, a swash plate hydraulic damping apparatus for controlling the rate at which the door closes, and a one-way clutch. The one-way clutch is responsive to the opening of the door for rotating in a first direction to wind up the torsional spring without operating the damping apparatus, but is responsive to the release of the door and the unwinding of the torsional spring for reversing the process and closing the door. As the spring unwinds, the one-way clutch mechanism operates the swash plate hydraulic damping apparatus to control the rate at which the door closes so as to insure a relatively constant closing force.

The door closing apparatus may be mounted within a compact housing which can be concealably mounted within the door itself or in close proximity thereto. In the preferred embodiment, the door closing apparatus is embodied in the central portion of a hinge. The hinge has a first hinge plate secured to the door casing and a second hinge plate secured to the door. The housing which compactly retains the torsional spring, the one-way clutch, and the swash plate hydraulic damping apparatus is rigidly secured to one of the hinge plates while the other hinge plate is coupled to the one-way clutch for operating the assembly.

The door closing apparatus is extremely compact and does not require a large housing thereby enabling it to be installed in a relatively small sized hinge assembly. The maximum available diameter of the housing is used for the torsional spring so as to achieve the maximum spring force for a given housing diameter and the housing may be provided with an aperture which provides access to a plurality of adjustment holes on the periphery of the swash plate to allow the damping force to be selectively adjusted.

The door closing apparatus is extremely simple and efficient and no large, unsightly, bulky apparatus is readily visible thereby improving the aesthetic appearance of the area. Additionally, all of the apparatus is concealably retained within the housing which can be mounted within the door or which can function as a part of the door hinge so as to prevent injury and property damage.

Other advantages and meritorious features of the present invention will be more fully understood from the following detailed description of the drawings and the preferred embodiment, the appended claims and the drawings which are briefly described hereinbelow.

BREIF DESCRIPTION OF THE DRAWINGS

FIG. 2 is a partially sectional, front view of a hinge assembly embodying the door closing apparatus of the preferred embodiment of the present invention.

FIG. 3 is a top plan view of the hinge assembly of FIG. 2;

FIG. 4 is a bottom view of the hinge assembly of FIG. 2 illustrating the positional locking mechanism of the present invention;

DESCRIPTION OF THE PREFERRED EMBODIMENT

Figure 1:
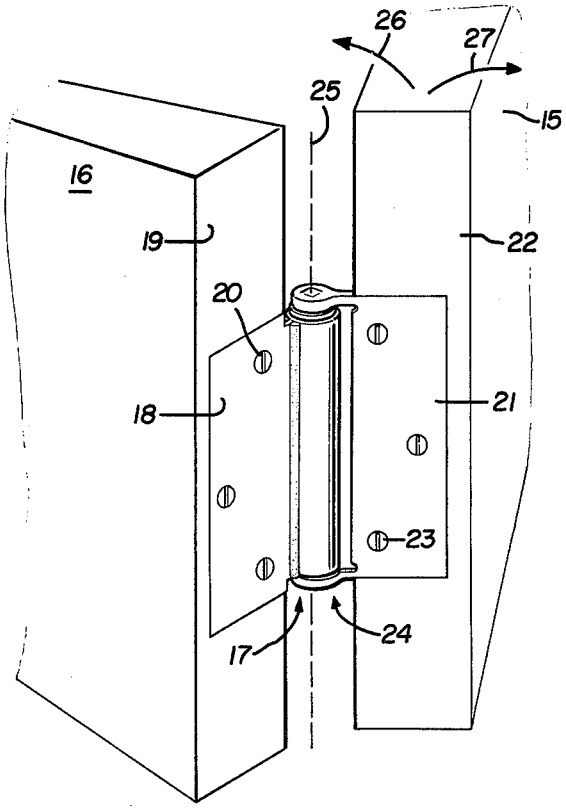
FIG. 1 is a fragmentary perspective view of a hinge assembly embodying the door closer of the present invention.

FIG. 1 shows a door 15 which is swingably mounted to a door casing 16 by the automatic door closing apparatus 17 of the present invention. In the preferred embodiment, a first hinge plate 18 is secured to the side of edge 19 of the door jamb or casing 16 by means of screws 20 or some other conventional fastening means and a second hinge plate 21 is secured to the side 22 of the door 15 by means of screws 23 or some similar fastening means. The first and second hinge plates 18, 21 are coupled together by a central hinge portion 24 for hinge-like rotational motion about a hinge axis 25. In operation, the door 15 may be opened in the direction indicated by the arrow 26 which is counter-clockwise when viewed from above along the hinge axis 25 and closed by moving it in a direction indicated by the arrow 27 which is clockwise when viewed from above along the hinge axis 25.

FIG. 2 shows the automatic door closing apparatus 17 of the present invention embodied in a hinge mechanism as illustrated in FIG. 1. The door closing apparatus 17 of FIG. 2 includes a torsional spring 28, a one-way clutch assembly 29, and a swash plate hydraulic damper 30, all of which are concealably retained in a compact manner within a generally cylindrical housing 31 which serves as the central hinge portion 24 of FIG. 1. The first hinge plate 18 is rigidly secured to the housing 31 as by weld joints 32 or the like and the second hinge plate 21 is coupled to the one-way clutch assembly 29.

In operation, when the door 15 is opened, the second hinge plate 21 is caused to rotate about the hinge axis of 25 and winds up the torsional spring 28 to store energy therein. When the door is released, the torsional spring 28 unwinds to reverse the process and close the door. The one-way clutch assembly 29 serves to disable the damper 30 when the door is opened but allows it to be operated as the door is closing so as to control the rate at which the torsional spring 28 unwinds to close the door 15.

Figure 5:
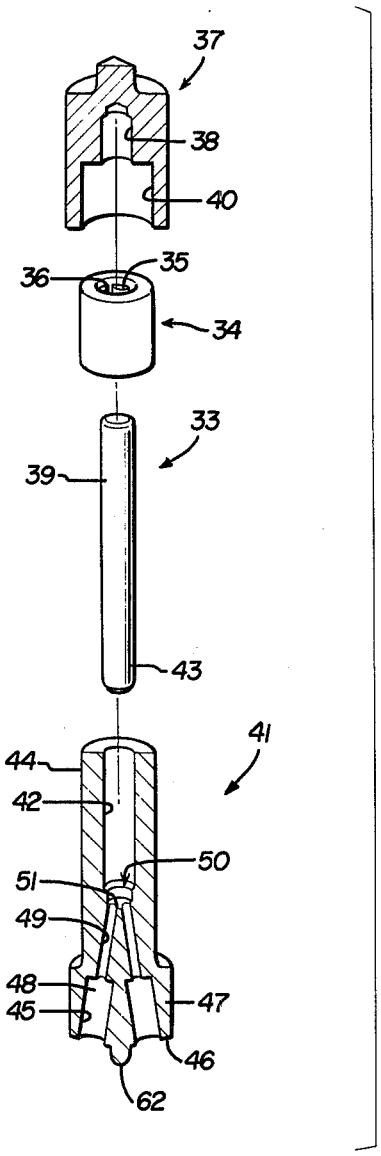
FIG. 5 is an exploded view of the one-way roller clutch of the present invention and the members to which it is coupled.

The one-way clutch assembly of FIGS. 2 and 5 include a conventional Torrington one-roller clutch having a shaft-like member or pin 33 and a collar assembly 34. The collar 34 is an annular member having a plurality of rollers 35 disposed about the inner wall 36 thereof. The annular collar 36 is adapted to receive the shaft 33 therethrough. The rollers 35 are disposed in the wall 36 such that the annular collar 34 is able to rotate freely with respect to the shaft 33 in a first direction. If, however, an attempt is made to rotate the collar 34 in the opposite direction, the rollers alter their position to positively grip the shaft 33 so that there is no relative motion therebetween thereby causing the shaft 33 to rotate in the opposite direction with the collar 34.

The collar 34 is coupled for rotation with the second hinge plate 21 as the door 15 is opened and closed through a first rotatable element 37. The first rotatable element 37 includes a channel 38 having its axis aligned with the hinge axis 25 for receiving a first end portion 39 of the shaft 33 in a slip-fit manner so that the shaft 33 is free to rotate within the channel 38. Additionally, the first rotatable element 37 includes a collar chamber 40 having its axis coincident with the hinge axis 25. The collar chamber 40 is so dimensionally adapted to retainably receive the collar 34 of the one-way clutch assembly 29 in a press fit manner so that the collar 34 is retainably held by the first rotatable element 37 for rotation therewith in either direction.

A second rotatable element 41 couples the damper 30 to the shaft 33 of the one-way clutch assembly 29. The second rotatable element 41 includes a shaft channel 42 which has its axis coincident with the hinge axis 25 formed in one end 44 thereof. The shaft channel 42 is dimensioned so as to receiveably retain the opposite end portion 43 of the shaft 33 in a press-fit manner so that the second rotatable element 41 can only rotate with the shaft 33.

The second rotatable element 41 has formed therein a plurality of piston chambers 45 which converge radially inwardly from the openings 46 at the opposite end 47 of the second rotatable element 41 towards the hinge axis 25 adjacent said one end 44 of the second rotatable element 41. The rear portions 48 of each of the piston chambers 45 are interconnected by a plurality of fluid paths or channels 49 which converge to meet a common chamber 50 located at the innermost end 51 of the shaft channel 42. Since the common chamber 50 is closed to the outward flow of fluid therefrom by the insertion of the shaft 33 into the shaft channel 42, a closed fluid path or circuit is created between the rear portions of 48 of the piston chambers 45 and the common chamber 50 via the fluid paths 49 so as to allow fluid to flow from one piston chamber 45 to another as required.

Each of the piston chambers 45 has disposed therein a generally cylindrical or bullet-shaped piston element 52 having a fluid contacting rear surface 53, an O-ring type resilient seal 54 disposed around the piston element 52 for preventing the escape of fluid from the piston chamber 45 and a head portion 55 which is adapted to extend from the piston chamber 45 through the openings 46 so that a generally spherical tip 56 is able to contact the upper surface 57 of a swash plate 58 which provides the restricting or retarding action of the hydraulic damper 30.

Figure 6:
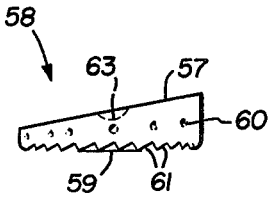
FIG. 6 is a side view of the swash plate of the hydraulic damping apparatus of FIG. 2.
Figure 7:
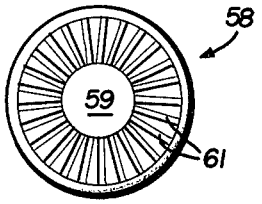
FIG. 7 is a bottom view of the swash plate of FIG. 6 illustrating the serrated portions for preventing slippage.

As illustrated in FIGS. 6 and 7 the swash plate 58 is shown to comprise a generally circular, disk-shaped element having a generally wedge-shaped cross section as viewed along one of its diameters. If a plane substantially parallel to the bottom surface 59 of the swash plate 58 were to represent a reference plane, then a plane parallel to the upper surface 57 of the plate 58 would form an acute angle with respect to the referenced plane. A plurality of equidistantly spaced apertures 60 are provided about the periphery of the plate 58 for adjustment purposes as hereinafter described.

As shown in FIG. 7, the bottom surface 59 is provided with a plurality of equidistantly spaced teeth or serrations 61 to prevent slippage of the plate 58 within the housing 31. Additionally, as illustrated in FIGS. 2, 5 and 6, the second rotatable element 41 is provided with a centering member 62 located on the bottom surface of the opposite end 47 thereof. The centering member 62 is located on the hinge axis 25 and is received loosely within a centering recess 65 of the swash plate 58 to keep the swash plate centered within the housing 31 during operation and during rotational adjustments.

As illustrated in FIGS. 2, 8, 9 and 10, the bottom portion 64 of the housing 31 has a generally sloped circular surface 65 upon which the bottom surface 59 of the swash plate 58 is disposed. A portion of the bottom surface 65 may be provided with teeth or serrations 94 to cooperate with the serrations 61 of the swash plate 58 to prevent slippage. The housing 31 may also be provided with an access aperture or opening 66 through which an appropriate tool or instrument can be inserted to engage the adjustment apertures 60 about the periphery of the disk-shaped swash plate 58 for rotating the swash plate 58 with respect to the stationary bottom portion 64 of the housing 31 to selectively vary the damping effect.

Figure 8:
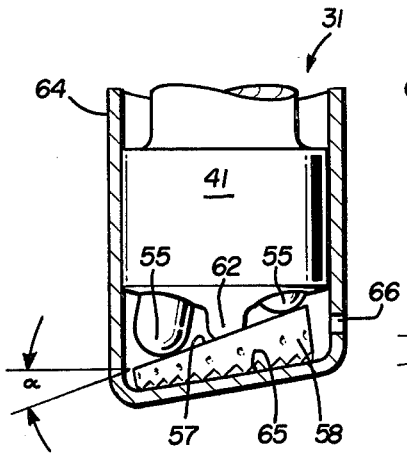
FIG. 8 is a fragmentary, partially sectional side view of the bottom portion of the housing of FIG. 2 with the swash plate positioned for maximum damping effect.
Figure 9:
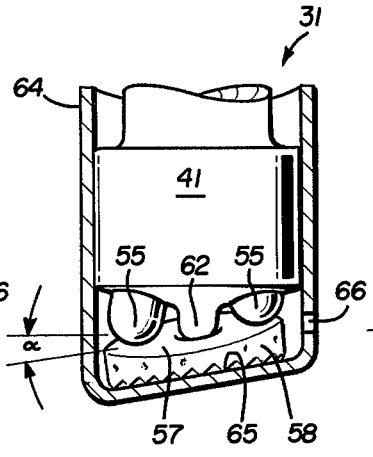
FIG. 9 is a fragmentary, partially sectional side view of the bottom portion of the housing of FIG. 2 with the swash plate adjusted to produce an intermediate damping effect.
Figure 10:
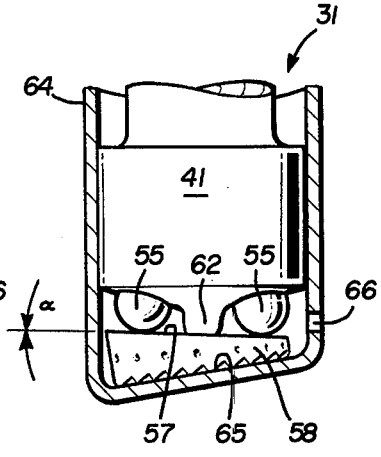
FIG. 10 is a fragmentary, partially sectional, side view of the bottom of the housing of FIG. 2 with the swash plate adjustably positioned to produce a minimum damping effect.

FIGS. 8, 9 and 10 show three different positions of the swash plate 58 with respect to the bottom portion 64 of the housing 31. In FIG. 8, the swash plate 58 is shown as being positioned to produce maximum damping effect since the pistons 52 will encounter the greatest or maximum resistance as they attempt to rotate in contact with the upper surface 57 of the swash plate 58. It will be seen that the angle alpha, which is defined as the angle between a horizontal plane perpendicular to the hinge axis 25 and a plane parallel to the sloped upper surface 57 of the swash plate 58, is a maximum.

In FIG. 9, the swash plate 58 has been rotated to an intermediate position and it will be noted that the angle alpha is something less than it was in FIG. 8, indicating that the pistons 52 will encounter less resistance as the second rotatable element 41 is rotated when the torsional spring 28 unwinds. FIG. 10 represents the minimum dampening effect and it will be observed that the angle alpha approaches zero as the swash plate 58 is turned so that the plane of the upper surface 57 coincides with the reference plane. In this position, the pistons 52 of the second rotatable element 41 encounter a minimum of resistance and the torsional spring 28 is able to unwind in a minimally damped or totally undamped state. Any degree of damping effect can be achieved between the minimum damping action of FIG. 10 and the maximum damping action of FIG. 8 by adjustably positioning or rotating the swash plate 58 by means of adjustment apertures 60 so as to change the angle alpha and therefore the resistance encountered by the extending tips 56 of the piston elements 52.

The variable damping action described hereinabove is accomplished since the displacement of the swash plate-type hydraulic pump 30 increases as the angle alpha increases. This means that the total stroke of each of the pistons 52 is correspondingly increased, and since the withdrawal motion of the pistons 52 as they protrude out of the chambers 45 via openings 46 is restricted by the upper surface 57 of the swash plate 58, damping action results.

As illustrated in FIGS. 2, 3 and 4, it will be seen that the second hinge plate 21 which is rigidly secured to the door 15 has an upper arm portion 67 retainably secured to an extension 68 of the first rotatable element 37. The extension 68 is retainably secured within a force fit aperture 69 located at one end 70 of the arm portion 67 such that the extension and the first rotatable element 37 which is integral therewith rotate with the second hinge plate 21 as the door 15 is opened and closed.

The opposite end of the second hinge plate 21 has a corresponding lower arm portion 71. The end 72 of the arm 71 has an aperture 73 formed therein. The aperture 73 is circular and is adapted to loosely fit over a cylindrical post 74 about which the arm 71 is free to pivot. The cylindrical post 74 is rigidly secured to the bottom portion 64 of the housing 31 by weld joints 75 or by any suitable fastening means.

The lower end 76 of the cylindrical post 74 is provided with a pair of locking slots 77 which are perpendicular to one another. A pair of pivot pin mounts 78 are secured to the end 72 of the lower arm portion 71 on the side of the post 74 opposite to the side on which the lower arm portion 71 is located. The pin mounts 78 retainably mount a pivot pin 79 therebetween such that a locking lever 80 having an aperture 81 at one end 82 thereof may be mounted between the pin mounts 78 such that the pivot pin 79 passes through the aperture 81 and mounts the locking lever 80 for pivotal rotation about the axis of the pivot pin 79.

When the door is opened such that the second hinge plate 21 forms an angle of 90 or an angle of 180 with the hinge plate 18, the locking lever 80 may be manually operated such that an intermediate portion 83 thereof may be placed within one of the two locking slots 77 to lock the door in that predetermined position. The opposite end 84 of the locking lever 80 has a cross bar 85 generally perpendicular to the axis of the locking lever 80 and a pair of upwardly disposed tines 86 adapted to be disposed on both sides of the lower arm portion 71 for manual gripping and to further insure locking when the door is in the 180° position.

The operation of the door closing apparatus of the present invention will be described with reference to FIGS. 1, 2, 4 and 5. When the door 15 is opened, the second hinge plate 21 rotates with the door 15 and the upper arm portion 67 which is secured to extension 68 causes the first rotatable element 37 to rotate in a first direction about the hinge axis 25. Since the first rotatable element is secured to the collar 34 of the one-way clutch assembly 29, the collar 34 rotates freely with respect to the shaft 39 without causing the shaft to rotate. Therefore, the damper 30 is not operated while the door is being opened but the torsional spring 28 is wound up to store energy therein as the first rotatable element 37 rotates in said first direction.

When the door is released, the energy stored in a torsional spring 28 is released and the spring 28 is unwound to rotate the first rotatable element 37 and hence the collar 34 in the opposite direction. When the collar 34 starts to rotate in the opposite direction, the rollers 35 positively grip the shaft 33 so that the shaft 33 rotates in the opposite direction with the first rotatable element 37 as the torsional spring 28 unwinds. As the shaft 33 rotates in the opposite direction as the spring 28 unwinds, it causes the second rotatable element 41 which is secured thereto to rotate in the opposite direction as well. The rotation of the second rotatable element 41 causes the tips 56 of the piston elements 52 to bear against the upper surface 57 of the swash plate 58. As the piston elements 52 move in and out of the piston chambers 45 in accordance with the adjusted position of the swash plate 58 with respect to the sloped surface 65 of the bottom of the housing 31 the damping effect is achieved. The tilt angle of adjustment of the swash plate 58 determines the amount of restricting or retarding effect produced by the damper 30 and therefore controls the rate at which the torsional spring 28 unwinds to close the door 15. To reduce friction, an annular thrust washer (not shown) may be placed between tips 56 of pistons 52 and the upper face of swash plate 58, the central opening of such washer providing clearance for centering member 62.

Additionally, the door may be locked at either the 90 or the 180 position by positioning the locking lever 80 within one of the locking slots 77 on the bottom end 67 of the cylindrical post 74 if desired. If it is desireable to increase or decrease the amount of damping, the position of the swash plate 58 with respect to the sloped surface 65 of the bottom 64 of the housing 31 may be varied by the insertion of a tool or adjustment instrument within the access port 66 to engage the adjustment apertures 60 about the periphery of the swash plate 58 for rotating the plate 58 about the axis of rotation or hinge axis 25 to vary the angle alpha.

In practice, maximum utilization is made of the available diameter ("*d*" in FIG. 3) of the housing 31 since the torsional spring 28 is disposed immediately radially inwardly of the walls of the housing 31 so as to give maximum spring force for a given diameter of the housing 31. One end 87 of the torsional spring 28 is secured to the first rotatable element 37 while the opposite end 88 of the torsional spring 28 is anchored to the housing 31 as by insertion through an anchoring aperture 89 or the like. The vent 90 provides an escape path for the air which is within the shaft channel 42 when the end portion 43 of the shaft 33 is force fitted into the channel 42.

While the preferred enbodiment of the present invention has been disclosed with specific reference to incorporation within a hinge, it will be understood that the same unit with or without the housing 31 could be employed in the environment set forth in applicant's copending application cited above, the disclosure of which is incorporated by reference herein.

With this detailed description of the specific apparatus used to illustrate the prime embodiment of the present invention and the operation thereof, it will be obvious to those skilled in the art that various modifications can be made in this door closing apparatus without departing from the spirit and scope of the present invention which is limited only by the appended claims.

I claim:

1. A door closing apparatus comprising a swash plate hydraulic damping apparatus for controlling the rate at which a door closes with respect to a fixed support to provide a relatively constant closing force, said damping apparatus having a swash plate with at least one sloping surface, piston means for engaging said swash plate, second rotatable means for effecting relative motion between said piston means and said swash plate such that the rotational resistance encountered as said piston means operatively engages said swash plate is proportional to the rate of rotation of said second rotatable means, spring means having a first portion anchored to one of said door and said fixed support and said spring means also having a second portion, and a first rotatable means operatively coupled between said second portion and the other of said door and said fixed support for rotating in a first direction when said door is opened to wind-up said spring means, said first rotatable means being responsive to the unwinding of said spring means when said door is released for rotating in a direction opposite to said first direction, and a one-way clutch means having an input element operatively coupled to said first rotatable means for rotation therewith and an output means responsive to the rotation of said first rotatable means in said opposite direction for controllably rotating said second rotatable means to close said door with a relatively constant closing force.

2. The door closing apparatus of claim 1 wherein said second rotatable means includes a generally cylindrical portion having a plurality of piston chambers formed therein and a closed fluid circuit restrictively interconnecting said piston chambers for receivably retaining a constant volume of hydraulic fluid therein, and wherein said piston means includes piston elements slidably disposed within each of said piston chambers, each of said piston elements having an end portion extending at least partially from said piston chamber for operatively engaging said swash plate.

3. The door closing apparatus of claim 1 further including means for housing at least a portion of said spring means, said one-way clutch means and said swash plate hydraulic damping apparatus in a compact manner.

4. The door closing apparatus of claim 3 further characterized in that said housing means is generally cylindrical and is secured with respect to said door so as to house substantially all of said spring means, said one-way clutch means and said damping apparatus.

5. The door closing apparatus of claim 3 further including a hinge mechanism having a first hinge plate adapted to be secured to said fixed support, a second hinge plate adapted to be secured to said door, and a central sleeve portion secured to one of said hinge plates for defining a hinge axis and for serving as said housing means.

6. The door closing apparatus of claim 3, further including a hinge mechanism having a first hinge plate adapted to be secured to said fixed support, a second hinge plate adapted to be secured to said door, and a central sleeve portion secured to one of said hinge plates for defining a hinge axis and serving as said housing, and wherein said second rotatable means is substantially housed within said central sleeve portion, said housing is rigidly secured to one of said hinge plates and said apparatus further includes means operatively coupled between the other of said hinge plates and said second rotatable element for rotating same as said door is opened and closed.

7. An automatic door closing apparatus comprising a hinge mechanism having first and second hinge plates, one of said plates being adapted to be secured to a door casing and the other of said plates being adapted to be secured to a door, said hinge mechanism also including a sleeve portion secured to said first hinge portion and having a longitudinal sleeve axis corresponding to the axis of said hinge, a spring assembly including a torsional spring, having one end anchored to said sleeve portion, first means operatively coupled between said second hinge plate and the opposite end of said torsional spring, said first means being responsive to the opening of said door for rotation in a first direction to wind-up said spring to store energy therein and to the unwinding of said spring when said door is released for rotating in the opposite direction to restore said door to its closed position, a hydraulic damping means for controlling the rate at which said spring unwinds to close said door, and one-way clutch means having an input element operatively coupled to said first means and an output element operatively coupled to said damping means for operating said damping means only when said first means is rotated in said opposite direction.

8. The automatic door closing apparatus of claim 7 further characterized in that said one-way clutch means includes a one-way roller clutch, said input element includes an annular collar having a plurality of roller members disposed about an inner portion of said collar, and said output element includes a shaft adapted to be disposed within said collar such that said collar may be freely rotated about said shaft in said first direction about said hinge axis but said rollers being operable to positively grip said shaft when said collar is rotated in said opposite direction, wherein said first means includes a first rotatable element adapted to positively engage the outer periphery of said collar for rotating with said collar when said door is opened and closed, and wherein said damping means includes a second rotatable element for positively engaging a portion of said shaft for rotation therewith, said first rotatable element having one end of said torsional spring anchored thereto and being secured to said second hinge plate for rotating in said first direction and winding up said torsional spring when said door is opened, said second rotatable element normally remaining stationary while said collar is rotated in said first direction but being responsive to the rotation of said collar and said shaft in said opposite direction under the force of said unwinding spring to rotate to operate said hydraulic damper so as to close said door with a relatively constant force.

9. The automatic door closing apparatus of claim 7, wherein said hydraulic damping means includes a rotatable element operatively connected to said output element, said rotatable element including a plurality of piston chambers formed therein, a closed fluid path interconnecting said piston chambers, a piston element disposed within each of said chambers, and wherein said damping means further includes a swash plate for operably engaging the protruding ends of said pistons and controlling the rate at which said rotatable element can be rotated in said opposite direction to close said door.

10. The automatic door closing apparatus of claim 9, wherein said damping means further includes means for adjustably varying the position of said swash plate for selectively controlling the resistance encountered by said pistons and hence the rate at which said spring unwinds to close said door.

11. The automatic door closer of claim 9, further characterized in that said sleeve portion includes a sloped portion on the inside bottom thereof which forms an acute angle with a plane normal to said hinge axis and said swash plate is a generally circular, disk-like member having a wedge-shaped cross-section through a diagonal thereof, said swash plate having a generally planar bottom surface adapted to be disposed on said sloped portion and a sloped upper surface adapted to engage the extended portions of said pistons, the selective rotation of said swash plate on said sloped portion presenting different upper surface slope angles to the extended portions of said pistons thereby selectively varying the resistance presented to the rotation of said rotatable element.

12. The automatic door closer of claim 11, further characterized in that said bottom surface of said swash plate includes a plurality of circumferentially spaced teeth-like serrations to engage said sloped portion of said sleeve and prevent slippage.

13. The automatic door closer of claim 11 further characterized in that the radially outer periphery of said swash plate is provided with a plurality of spaced recesss for enabling said swash plate to be selectively rotated with respect to the sloped bottom portions of said sleeve.

14. The automatic door closer of claim 7, wherein said sleeve includes an end portion having at least one externally-facing slot therein, said door closing further including a locking lever having one portion adapted for receivably engaging a portion of said second hinge plate and means for pivotally mounting said locking lever on said sleeve, such that it may be manually positioned such that an intermediate portion thereof may be disposed within said slot while said one portion engages a portion of said second hinge plate for locking said door in a predetermined opened position.

15. In a door closing apparatus having a spring means, a one-way clutch means, housing means coupled to one of a door and a fixed support for supporting housing said spring means and said one-way clutch means, a first means operably coupled between said one-way clutch means and the other of said door and said fixed support, said first means being responsive to the opening of said door for rotating in a first direction and winding up said spring means, and second means coupled to said one-way clutch means for rotating in the opposite direction only when said spring means unwinds to close said door, the improvement comprising a highly efficient, compact hydraulic damping apparatus for controlling the rate of which said spring means unwinds to close said door with a relatively constant closing force, said damping apparatus including a plurality of piston chambers formed in said second means, fluid passage means coupling the inner portion of said chambers to form a closed fluid path for retaining a fixed volume of hydraulic fluid, piston elements slidably disposed in each of said chambers and having an end portion extending therefrom, and means adapted to operatively engage the extending end portions of said pistons to restrict the rate of rotation of said second means and therefore the rate at which said spring means unwinds to close said door.

16. The improved door closing apparatus of claim 15, further characterized in that said restricting means includes a swash plate and means for selectively positioning said swash plate to control the stroke resistance experienced by said piston elements and therefore the rate at which said spring means unwinds to close said door.

17. The improved door closing apparatus of claim 15, further characterized in that substantially all of said spring means, said one-way clutch means, said second means, and said damping apparatus and a portion of said first means are operably and concealably retained in a compact manner within said housing.

18. The improved door closing apparatus of claim 16 wherein said housing forms a portion of a hinge assembly with the axis of said housing corresponding to the hinge axis of said assembly and wherein said door closing apparatus further includes a first hinge plate rigidly secured to said housing and adapted to be secured to one of said door and said fixed support and a second hinge plate operably connected to said first means and adapted to be secured to the other of said door and said fixed support such that said first means rotates in said first direction and in said opposite direction as said door is opened and closed respectively.

19. The improved door closing apparatus of claim 17, further characterized in that said housing is generally cylindrical and has a sloped portion on the inside bottom thereon and wherein said restricting means includes a generally cylindrical, wedge-shaped, disk-like plate disposed upon said sloped bottom and adapted to be rotated upon said bottom so as to selectively vary the resistance which the upper surface of said wedge-shaped plate presents to the extended end portions of said pistons.

20. The improved door closing apparatus of claim 15, wherein each of said piston chambers is disposed at an acute angle to the vertical axis of said housing so that the inner portions thereof converge so as to maximize the lateral spread of said piston elements where their end portions contact said restricting means to maximize lift and to minimize side loading and wear.

21. The improved door closing apparatus of claim 19, further characterized in that said restricting means includes adjustment means for selectively varying the resistance which the upper surface of said wedge-shaped plate presents to the exposed ends of said piston elements so as to selectively control the rate of which said spring unwinds to close said door.

22. The improved door closing apparatus of claim 19 wherein said housing further includes means for selectively locking said door in a predetermined opened position.

23. An apparatus for automatically closing a door with respect to a fixed support adjacent thereto comprising a generally cylindrical housing, means for securing said housing to one of either said door or said fixed support, a one-way clutch having a first rotatable means, a torsional spring coiled about at least a portion of said one-way clutch and having one end anchored with respect to said housing and the other end secured to said first rotating means, means for coupling said first rotating means to the other of said door or said fixed support for rotation in a first direction when said door is opened to wind-up said torsional spring and for rotation in the opposite direction when said door is released and said torsional spring unwinds to close said door, said one-way clutch further including a second rotational means responsive only to the rotation of said first rotational means in said opposite direction for rotating therewith, a hydraulic damping means including a plurality of piston chambers disposed in said second rotatable means, a closed hydraulic circuit commonly connecting each of said piston chambers, a piston element slidably disposed in each of said piston chambers for sealing same, each of said piston element having one end extending from said piston chamber, a sloped plate adapted to be operatively engaged by the exposed ends of said piston elements for restricting rotation of said second rotating means, means for concealably and supportably retaining said torsional spring, said one-way clutch, and said hydraulic damping means compactly within said housing, and means for selectively adjusting the position of said sloped plate with respect to the exposed ends of said piston elements for varying the resistance experienced thereby so as to control the rate at which the door closes to insure a relatively constant closing force.

* * * * *